US008340535B2

(12) United States Patent
Uehara

(10) Patent No.: US 8,340,535 B2
(45) Date of Patent: Dec. 25, 2012

(54) IMAGE FORMING APPARATUS

(75) Inventor: Masakazu Uehara, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 338 days.

(21) Appl. No.: 12/845,185

(22) Filed: Jul. 28, 2010

(65) Prior Publication Data

US 2011/0044704 A1 Feb. 24, 2011

(30) Foreign Application Priority Data

Aug. 19, 2009 (JP) ..... 2009-190363

(51) Int. Cl.
*G03G 15/00* (2006.01)

(52) U.S. Cl. ..... 399/21; 399/124; 399/122; 399/400; 399/401; 399/405; 399/320

(58) Field of Classification Search ..... 399/21, 399/33, 67, 124, 122, 401, 400, 405, 322, 399/397, 320
See application file for complete search history.

(56) References Cited

U.S. PATENT DOCUMENTS

| | | | | |
|---|---|---|---|---|
| 6,177,666 | B1 * | 1/2001 | Akedo et al. | 250/208.1 |
| 7,176,952 | B2 * | 2/2007 | Ishida et al. | 347/156 |
| 7,574,158 | B2 * | 8/2009 | Uehara | 399/122 |
| 7,917,062 | B2 * | 3/2011 | Shin et al. | 399/124 |
| 8,005,399 | B2 * | 8/2011 | Sahara | 399/122 |
| 8,155,560 | B2 * | 4/2012 | Sahara | 399/122 |
| 2006/0018672 | A1 * | 1/2006 | Asaba | 399/21 |
| 2006/0171740 | A1 * | 8/2006 | Ogawa | 399/124 |

FOREIGN PATENT DOCUMENTS

| | | |
|---|---|---|
| JP | 2006-337527 | 12/2006 |

* cited by examiner

*Primary Examiner* — Matthew G Marini
(74) *Attorney, Agent, or Firm* — Smith, Cambrell & Russell, LLP

(57) ABSTRACT

An image forming apparatus includes: a fixing unit fixing an unfixed toner image formed by an image forming unit and transferred by a transfer unit on a recording medium; a discharge unit provided above the fixing unit and discharging the recording medium; a fixing jam processing cover rotating with respect to an apparatus main body so as to open or close a part of a paper conveyance path from the fixing unit to the discharge unit; a conveyance guide member swingably provided on the fixing jam processing cover and guiding the recording medium to the discharge unit; and a supporting member having an inclined surface with which the conveyance guide member makes contact and along which, as the fixing jam processing cover is being opened, the conveyance guide member slides to become less inclined with respect to a horizontal direction.

14 Claims, 8 Drawing Sheets

IMAGE FORMING APPARATUS

This application is based on Japanese Patent Application No. 2009-190363 filed on Aug. 19, 2009, the contents of which are hereby incorporated by reference.

BACKGROUND

1. Technical Field

The present disclosure relates to an image forming apparatus, such as a copier, a facsimile machine, and a printer, provided with a fixing unit that, by heating and fusing an unfixed toner image carried on a recording medium, fixes the image onto the recording medium, and, in particular, to a mechanism for processing a paper jam occurring between the fixing unit and a discharge unit located above the fixing unit.

2. Description of Related Art

Known as a fixing unit mounted in a conventional image forming apparatus using an electrophotographic method are: a heat roller fixing system in which at least one roller of a fixing roller pair forming a nip has a heat source built therein to thereby serve as a heating roller, and paper which carries an unfixed toner image is passed through the nip portion of this roller pair, so that the toner is fixed onto the paper; and a belt fixing system in which instead of the heating roller a heating belt is used which absorbs radiant light from a heat-generating source emits heat. The paper having the toner image fixed thereonto by the fixing unit is discharged onto a discharge tray by a discharge roller pair disposed on the downstream side of the fixing unit in a paper conveyance direction.

In a known configuration for an image forming apparatus provided with such a fixing unit, the paper conveyance path from the nip portion of the fixing roller pair to the discharge roller pair is designed to be openable in order to facilitate processing of a paper jam occurring around the fixing unit. For example, an image forming apparatus is known which has a fixing device provided with an openable first cover (detachment member protection cover) covering a separating member for separating paper from a heat fixing roller and an openable second cover (fixing jam processing cover) covering the first cover.

In the aforementioned image forming apparatus, if a jam occurs somewhere between the nip portion of the fixing roller pair and a conveyance guide member, jam processing can be safely performed by opening only the second cover, with the separating member, which is hot, covered by the first cover. On the other hand, if a jam occurs such that an edge of the paper is caught between the separating member and the fixing roller or such that the paper is completely wound around the fixing roller, jam processing can be performed by opening the first and second covers.

From another viewpoint, to minimize the height of an image forming apparatus, it helps to adopt a configuration in which the conveyance guide member is provided in an upper end portion of the fixing jam processing cover so that paper is guided to a paper discharge path closely above the fixing unit. However, in this configuration, in order to guide paper to the discharge roller pair disposed obliquely above the fixing device, the conveyance guide member is disposed obliquely upward. As a result, when the fixing jam processing cover is opened and closed in a vertical direction with a lower end portion thereof as a pivot, inconveniently, the conveyance guide member interferes with an upper portion of a main body of the image forming apparatus, hence hindering smooth opening and closing of the fixing jam processing cover. Incidentally, in the configuration of the previously mentioned image forming apparatus, the conveyance guide member is not provided in an upper end portion of the fixing jam processing cover, and therefore upon opening and closing the cover, the conveyance guide member does not interfere with the main body of the image forming apparatus.

One possible way to avoid interference of the conveyance guide member with the upper portion of the main body of the image forming apparatus upon opening and closing the fixing jam processing cover is to place a part of the apparatus main body frame of the image forming apparatus which may interfere with the conveyance guide member clear of the cover opening and closing trajectory. This, however, accordingly increases the height of the image forming apparatus. An attempt to avoid interference with the conveyance guide member may also be made by forming a cut or an opening in a part of the apparatus main body frame. This, however, reduces the stiffness of the apparatus main body of the image forming apparatus. In particular, in a case where an image reading unit is mounted above an upper part of the apparatus main body as in an MFP (multi-functional peripheral), and accordingly a reinforcement member such as a metal sheet is indispensable closely above the fixing unit, the method being discussed, in the first place, does not permit a reinforcement member to be provided in the opening and closing trajectory of the conveyance guide member, possibly leading to insufficient stiffness of the apparatus main body.

SUMMARY

In view of the problems described above, an object of the present disclosure is to provide an image forming apparatus which allows easy processing of a paper jam around a fixing unit while being low-profile and rigid.

To achieve the object described above, an image forming apparatus according to one aspect of the present disclosure includes: an image forming unit forming a toner image; a transfer unit transferring on a recording medium the toner image formed by the image forming unit; a fixing unit fusing an unfixed toner image transferred by the transfer unit to fix the toner image on the recording medium; a discharge unit provided above the fixing unit and discharging the recording medium having the toner image fixed thereon by the fixing unit; a fixing jam processing cover rotating with a lower end portion thereof as a pivot with respect to an apparatus main body so as to open and close a part of a paper conveyance path from the fixing unit to the discharge unit; a conveyance guide member swingably provided on a rotation end of the fixing jam processing cover and guiding, with the fixing jam processing cover closed, to the discharge unit the recording medium having passed through the fixing unit; and a supporting member having an inclined surface with which a part of the conveyance guide member makes contact and along which, as the fixing jam processing cover is opened, the conveyance guide member slides to become less inclined with respect to a horizontal direction.

Other objects of the present disclosure and specific advantages offered by the present disclosure will become apparent from the description of an embodiment thereof given below.

DETAILED DESCRIPTION OF PREFERRED EMBODIMENTS

Figure 1:
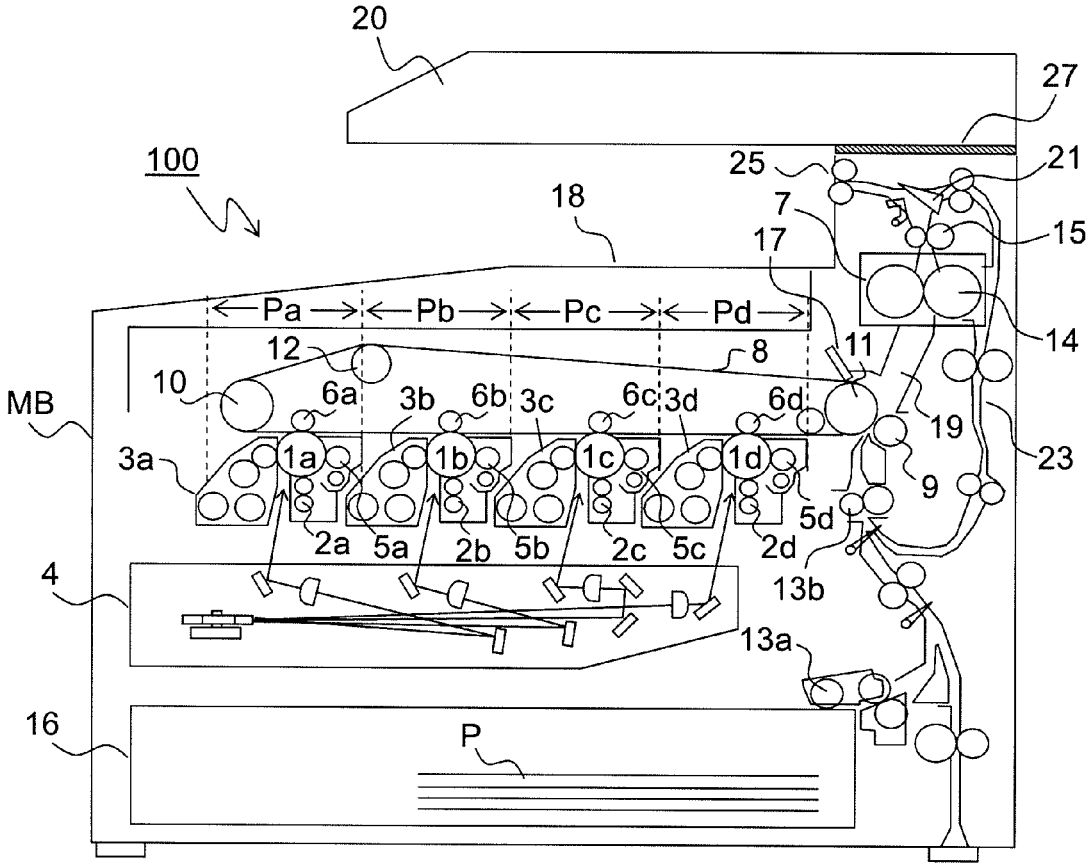
FIG. 1 is a schematic sectional view showing an internal configuration of an image forming apparatus according to an embodiment.

Hereinafter, an embodiment of the present disclosure will be described with reference to the accompanying drawings. FIG. 1 is a schematic view showing a configuration of an image forming apparatus 100 according to the embodiment. The image forming apparatus 100 is a tandem-type color copier, and in a main body of the color image forming apparatus 100, four image forming units Pa, Pb, Pc, and Pd are disposed in order from a left side in FIG. 1. The image forming units Pa, Pb, Pc, and Pd are respectively provided in correspondence with images of four different colors (yellow, cyan, magenta, and black), and sequentially form the images of yellow, cyan, magenta, and black through charging, exposure, and developing processes.

In the image forming units Pa, Pb, Pc, and Pd, photoconductive drums 1*a*, 1*b*, 1*c*, and 1*d* are respectively disposed on which visible images (toner images) of the respective colors are formed, and further, an intermediate transfer belt 8 which rotates counterclockwise in FIG. 1 is disposed so as to be adjacent to the respective image forming units Pa, Pb, Pc, and Pd. The toner images formed on these photoconductive drums 1*a*, 1*b*, 1*c*, and 1*d* are superimposed on one another by being sequentially transferred on the intermediate transfer belt 8 which moves while keeping contact with the respective photoconductive drums 1*a*, 1*b*, 1*c*, and 1*d*; thereafter, the toner images are transferred onto paper P as one example of a recording medium by action of a secondary transfer roller 9; further, the toner images are fixed on the paper P at a fixing unit 7; and thereafter, the paper P is discharged from the apparatus main body MB of the image forming apparatus 100. While the photoconductive drums 1*a*, 1*b*, 1*c*, and 1*d* are being rotated clockwise in FIG. 1, an image forming process on each of the photoconductive drums 1*a*, 1*b*, 1*c*, and 1*d* is executed.

The paper P on which the toner images are transferred is stored in a paper cassette 16 at a bottom part of the apparatus main body MB of the image forming apparatus 100 and is conveyed via a feed roller 13*a*, a registration roller pair 13*b*, and the like to a nip between the secondary transfer roller 9 and a driving roller 11 of the intermediate transfer belt 8 described later. As the intermediate transfer belt 8, a sheet of dielectric resin is used, and a belt without seams (seamless belt) is mainly used. Moreover, on the downstream side of the secondary transfer roller 9 in the moving direction of the intermediate transfer belt 8, a cleaning blade 17 for removing toner remaining on a surface of the intermediate transfer belt 8 is disposed.

An image reading unit 20 is composed of a scanning optical system including a scanner lamp for illuminating a document during copying and a mirror for altering an optical path of light reflected from a document, a condensing lens for collecting the light reflected from a document and forming an image, a CCD sensor for converting image light of the formed image to an electrical signal, and the like (none is shown), and the image reading unit 20 reads out and converts an image of a document to image data.

Next, the image forming units Pa, Pb, Pc, and Pd will be described. Provided around and below the photoconductive drums 1*a*, 1*b*, 1*c*, and 1*d* rotatably disposed are: charging devices 2*a*, 2*b*, 2*c*, and 2*d* for charging the photoconductive drums 1*a*, 1*b*, 1*c*, and 1*d*, respectively; an exposure unit 4 for exposing the photoconductive drums 1*a*, 1*b*, 1*c*, and 1*d* to light of image information and forming electrostatic latent images on the photoconductive drums 1*a*, 1*b*, 1*c*, and 1*d*, respectively; developing devices 3*a*, 3*b*, 3*c*, and 3*d* for developing the electrostatic latent images formed on the photoconductive drums 1*a*, 1*b*, 1*c*, and 1*d* and forming toner images on the photoconductive drums 1*a*, 1*b*, 1*c*, and 1*d*, respectively; and cleaning devices 5*a*, 5*b*, 5*c*, and 5*d* for removing developer (toner) remaining on the photoconductive drums 1*a*, 1*b*, 1*c*, and 1*d*, respectively.

When an instruction to start a copying process is entered, image data corresponding to a document image is prepared at the image reading unit 20, the charging devices 2*a*, 2*b*, 2*c*, and 2*d* first uniformly charge the surfaces of the photoconductive drums 1*a*, 1*b*, 1*c*, and 1*d*, respectively, and the exposure unit 4 subsequently irradiates the surfaces of the photoconductive drums 1*a*, 1*b*, 1*c*, and 1*d*, respectively, with light beams in accordance with the image data, so that electrostatic latent images in accordance with the image data from the image reading unit 20 are respectively formed on the photoconductive drums 1*a*, 1*b*, 1*c*, and 1*d*. The developing devices 3*a*, 3*b*, 3*c*, and 3*d* are provided with developing rollers (developer carriers) disposed so as to face the photoconductive drums 1*a*, 1*b*, 1*c*, and 1*d* respectively and are filled with predetermined amounts of two-component developers including toners of the respective colors of yellow, cyan, magenta, and black, respectively. These toners are supplied onto the photoconductive drums 1*a*, 1*b*, 1*c*, and 1*d* by the developing rollers of the developing devices 3*a*, 3*b*, 3*c*, and 3*d* respectively, and then electrostatically adhere thereto, so that toner images are formed in accordance with the electrostatic latent images formed as a result of the exposure by the exposure unit 4.

Then an electric field is provided by primary transfer rollers 6*a*, 6*b*, 6*c*, and 6*d*, which are disposed so as to be pressed against the respective photoconductive drums 1*a*, 1*b*, 1*c*, and 1*d* respectively with the intermediate transfer belt 8 interposed therebetween, between the primary transfer rollers 6*a*, 6*b*, 6*c*, and 6*d* and the photoconductive drums 1*a*, 1*b*, 1*c*, and 1*d* with a predetermined transfer voltage, and then the toner images of yellow, cyan, magenta, and black on the photoconductive drums 1*a*, 1*b*, 1*c*, and 1*d* are primarily transferred onto the intermediate transfer belt 8. These images of the four colors are formed in a predetermined positional relationship for the purpose of predetermined full-color image formation. Thereafter, in preparation for subsequent new electrostatic latent image formation, after the primary transfer, the toners remaining on the surfaces of the photoconductive drums 1*a*, 1*b*, 1*c*, and 1*d* are removed by the cleaning devices 5*a*, 5*b*, 5*c*, and 5*d* respectively.

The intermediate transfer belt 8 stretches over a driven roller 10, the driving roller 11, and a tension roller 12. As the driving roller 11 is rotated by a belt driving motor (not shown), the intermediate transfer belt 8 rotates counterclockwise in FIG. 1, and thus the paper P is conveyed at predetermined timing from the registration roller pair 13*b* to a nip portion (secondary transfer nip portion) between the secondary transfer roller 9 provided in proximity to the intermediate transfer belt 8 and the intermediate transfer belt 8. At the nip portion, a full-color toner image is secondarily transferred from the intermediate transfer belt 8 onto the paper P. Hereinafter, the full-color toner image is referred to as the toner image. The paper P having the toner image transferred thereon is conveyed to the fixing unit 7. The intermediate transfer belt 8, the primary transfer rollers 6*a*, 6*b*, 6*c*, 6*d* and the secondary transfer roller 9 constitute a transfer unit.

The paper P conveyed to the fixing unit 7 is heated and pressed when passing through a nip portion (fixing nip portion) of a fixing roller pair 14, so that the toner image is fixed on the surface of the paper P, and thereby a full-color image is formed on the paper P. The paper P having the full-color image formed thereon is routed via a conveyance roller pair 15, has a conveyance direction thereof guided by a conveyance guide member 21 disposed at a branching portion of a paper conveyance path 19, is discharged as it is (or after the paper P has been sent to a double-side conveyance path 23 and subjected to double-side copying) via the discharge roller pair 25 (discharge unit) to a discharge tray 18.

Specifically, the paper conveyance path 19 is structured so as to bifurcate into right and left pathways on the downstream side of the conveyance roller pair 15, with one (pathway branching off in a left direction in FIG. 1) of the pathways communicating with the discharge tray 18, and the other pathway (pathway branching off in a right direction in FIG. 1) communicating with the double-side conveyance path 23. Moreover, in order to enhance stiffness of the apparatus main body MB of the image forming apparatus 100 and support a weight of the image reading unit 20, a reinforcement metal sheet 27 as a reinforcement member is fitted between an upper surface of the apparatus main body MB and the image reading unit 20.

Figure 2:
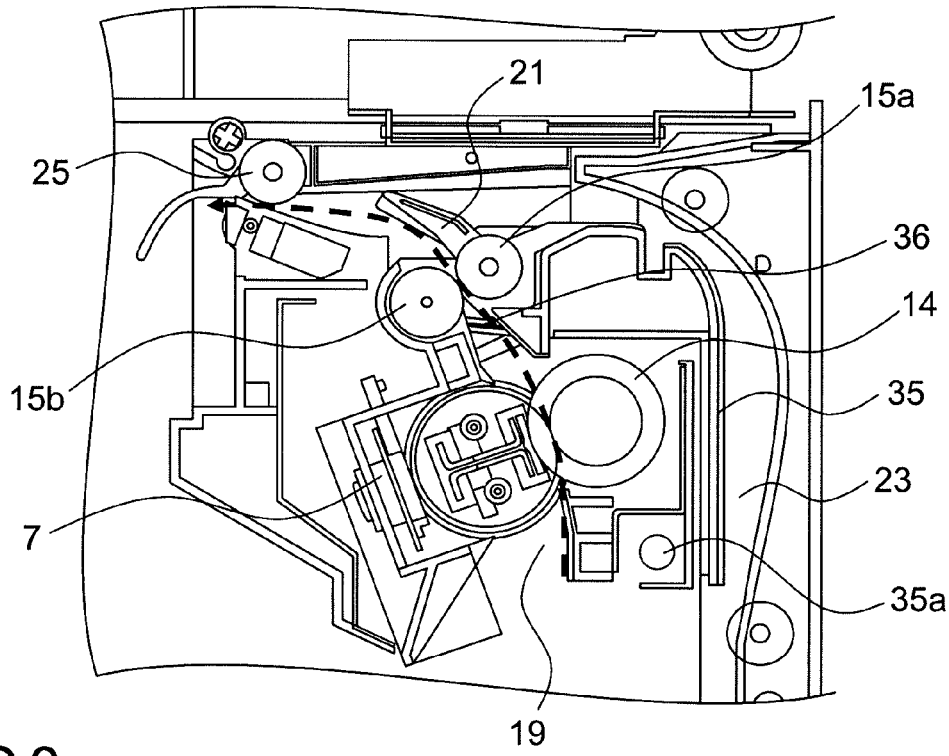
FIG. 2 is a partially enlarged diagram showing a view in which in the image forming apparatus according to the embodiment, paper is guided from a fixing unit to a discharge roller pair.
Figure 3:
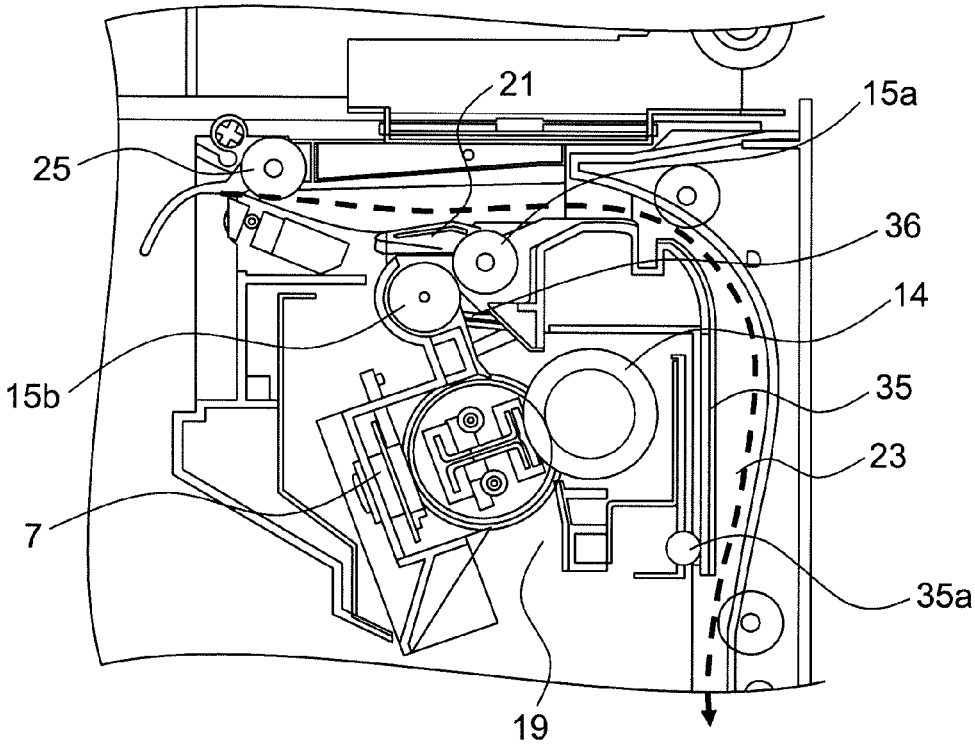
FIG. 3 is a partially enlarged diagram showing a view in which in the image forming apparatus according to the embodiment, the paper is guided from the discharge roller pair to a double-side conveyance path.

FIG. 2 and FIG. 3 are partially enlarged views of a periphery of the fixing unit in FIG. 1. With reference to FIG. 2 and FIG. 3, a paper conveyance route for double-side printing will be described in detail. The image forming apparatus 100 according to the embodiment has a configuration (back surface C path) in which a substantially C-shaped double-side conveyance path 23 is provided along a back surface of the apparatus main body MB. Once the toner image formed by the image forming units Pa, Pb, Pc, and Pd (see FIG. 1) is transferred on one side of paper at the secondary transfer nip portion, the paper then passes through the fixing roller pair 14 and the conveyance roller pair 15 in this order upward in the paper conveyance path 19 and reaches the conveyance guide member 21 as indicated by a dashed arrow in FIG. 2.

A fixing jam processing cover 35 constitutes a part (internal surface) of the double-side conveyance path 23 and a part (external surface) of the paper conveyance path 19 on the downstream side of (above) the fixing unit 7 and is supported in a vertically rotatable manner on a pivot 35*a* below the fixing unit 7. On a surface of the fixing jam processing cover 35, which constitutes the paper conveyance path 19, a roller 15*a* as one roller of the conveyance roller pair 15 and a paper detection sensor 36 for detecting passage of a leading edge or a trailing edge of the paper are disposed. On a leading end (rotation end of the fixing jam processing cover 35) of the fixing jam processing cover 35, a conveyance guide member 21 is swingably supported. By opening the fixing jam processing cover 35, the conveyance roller pair 15 is separated into the roller 15*a* on a side of the fixing jam processing cover 35 and a roller 15*b* on a side of the apparatus main body MB of the image forming apparatus 100, thereby exposing the paper conveyance path 19 from the fixing roller pair 14 to the discharge roller pair 25.

Figure 4:
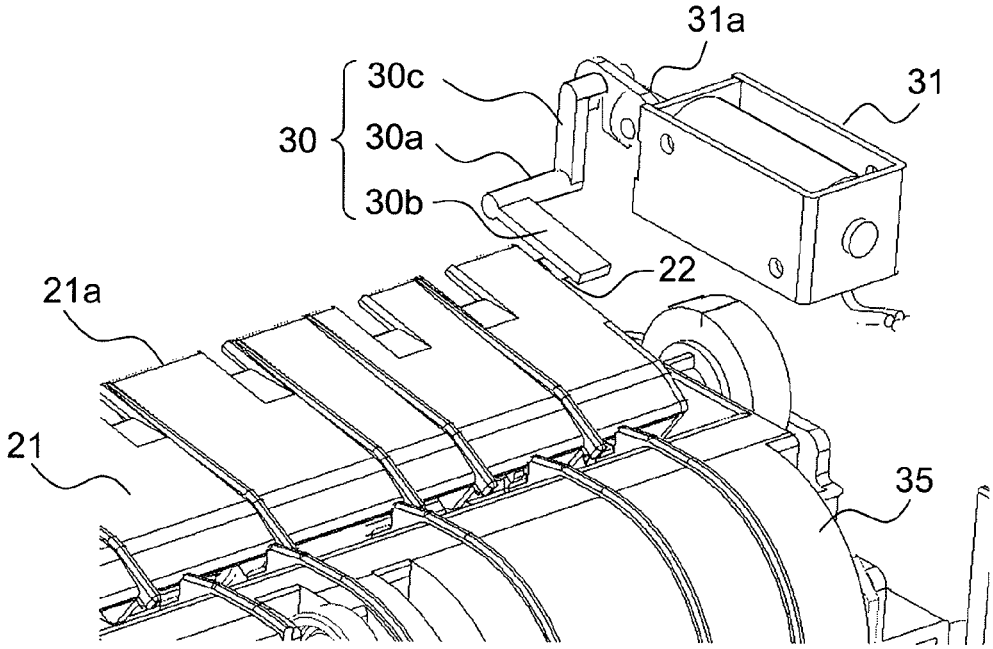
FIG. 4 is an enlarged perspective view showing a state where in the image forming apparatus according to the embodiment, a conveyance guide member is disposed in a position where the conveyance guide member guides the paper from the fixing unit to the discharge roller pair.
Figure 5:
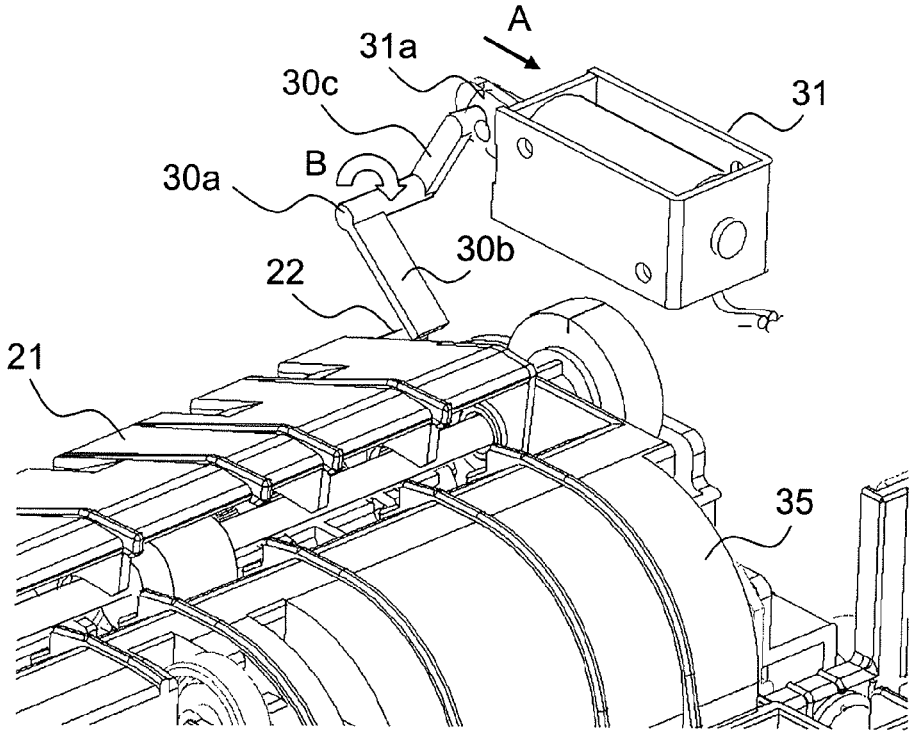
FIG. 5 is an enlarged perspective view showing a state where in the image forming apparatus according to the embodiment, the conveyance guide member is disposed in a position where the conveyance guide member guides the paper from the discharge roller pair to the double-side conveyance path.

FIG. 4 and FIG. 5 are enlarged perspective views showing a swinging mechanism of the conveyance guide member 21. In the vicinity of one longitudinal-direction end of the conveyance guide member 21 (on an innermost side of the sheet of FIG. 2 and FIG. 3), a link member 30 and a solenoid 31 are disposed. The link member 30 is crank-shaped, by being composed of a rotary shaft 30*a* rotatably supported on the apparatus main body MB and a first and a second arm part 30*b* and 30*c* formed on the circumferential surface of the rotary shaft 30*a* so as to protrude therefrom. A protruding portion 22 provided on a swinging end 21*a* of the conveyance guide member 21 contacts a lower end portion of the first arm part 30*b*, and a movable iron core 31*a* of the solenoid 31 is connected to the second arm part 30*c*.

Figure 10:
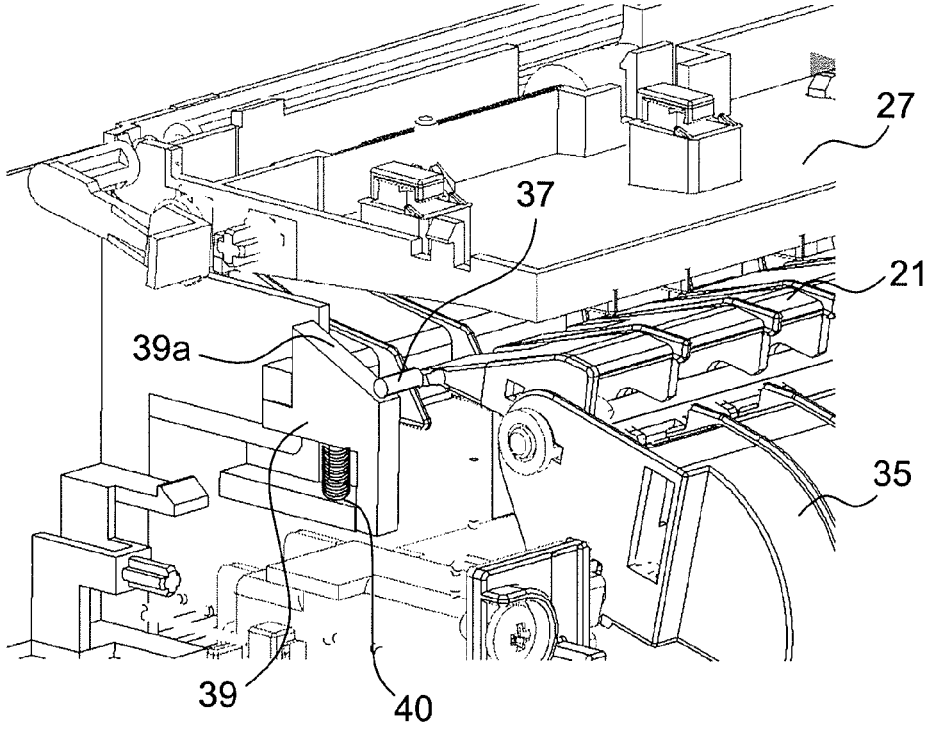
FIG. 10 is an enlarged view showing a state where the fixing jam processing cover in a state shown in FIG. 9 is rotated in an opening direction.

Ordinarily, the movable iron core 31 a is protruded from a main body of the solenoid 31 as shown in FIG. 4, and the swinging end 21*a* of the conveyance guide member 21 is supported obliquely upward by being lifted up by a supporting member 39 (refer to FIG. 10) urged upward by a coil spring 40 (an example of a resilient member; refer to FIG. 10). This allows the conveyance guide member 21 to be located in a position (hereinafter, referred to as a first position) where the conveyance guide member 21 guides the paper having passed through the fixing unit 7 to the discharge roller pair 25 as shown in FIG. 2. A leading edge of the paper having passed through the conveyance roller pair 15 is guided along a lower surface of the conveyance guide member 21 to the discharge roller pair 25 as indicated by the dashed arrow in FIG. 2.

The paper is discharged onto the discharge tray 18 by the discharge roller pair 25. When it is detected that a trailing edge of the paper has passed through the paper detection sensor 36, after a predetermined period of time, the discharge roller pair 25 stops for a while. At the same time, as shown in FIG. 5, the movable iron core 31 a of the solenoid 31 is drawn in a direction indicated by an arrow A, and the rotation axis 30*a* rotates via the second arm part 30*c* in a direction indicated by an arrow B. Thus, the first arm part 30*b* presses down the protruding portion 22 of the conveyance guide member 21 against an urging force of the coil spring 40. As a result, the conveyance guide member 21 becomes substantially horizontal as shown in FIG. 3, and is located in a position (hereinafter, referred to as a second position) where the conveyance guide member 21 guides the paper switched back at the discharge roller pair 25 to the double-side conveyance path 23.

Next, by reversely rotating the discharge roller pair 25, the paper is drawn again into an inside of the image forming apparatus 100 and guided along an upper surface of the conveyance guide member 21 to the double-side conveyance path 23 as indicated by a dashed arrow in FIG. 3. After the trailing edge of the paper has passed through the conveyance guide member 21, the solenoid 31 is actuated to protrude the movable iron core 31*a*, thereby locating again the conveyance guide member 21 in the first position.

Thereafter, the paper having passed through the double-side conveyance path 23 is conveyed up to an upstream side of the registration roller pair 13*b* with an image-formed surface thereof reversed (facing rightward in FIG. 1) and is stopped for a while. At predetermined timing, the paper is conveyed to the secondary transfer nip portion between the secondary transfer roller 9 and the driving roller 11, thereby transferring, on a paper surface having no image formed thereon, a new toner image formed on the intermediate transfer belt 8. The paper having the toner images formed thereon is routed via the fixing unit 7 and the conveyance roller pair 15, guided along the lower surface of the conveyance guide member 21 located in the first position to the discharge roller pair 25, and discharged onto the discharge tray 18.

Figure 6:
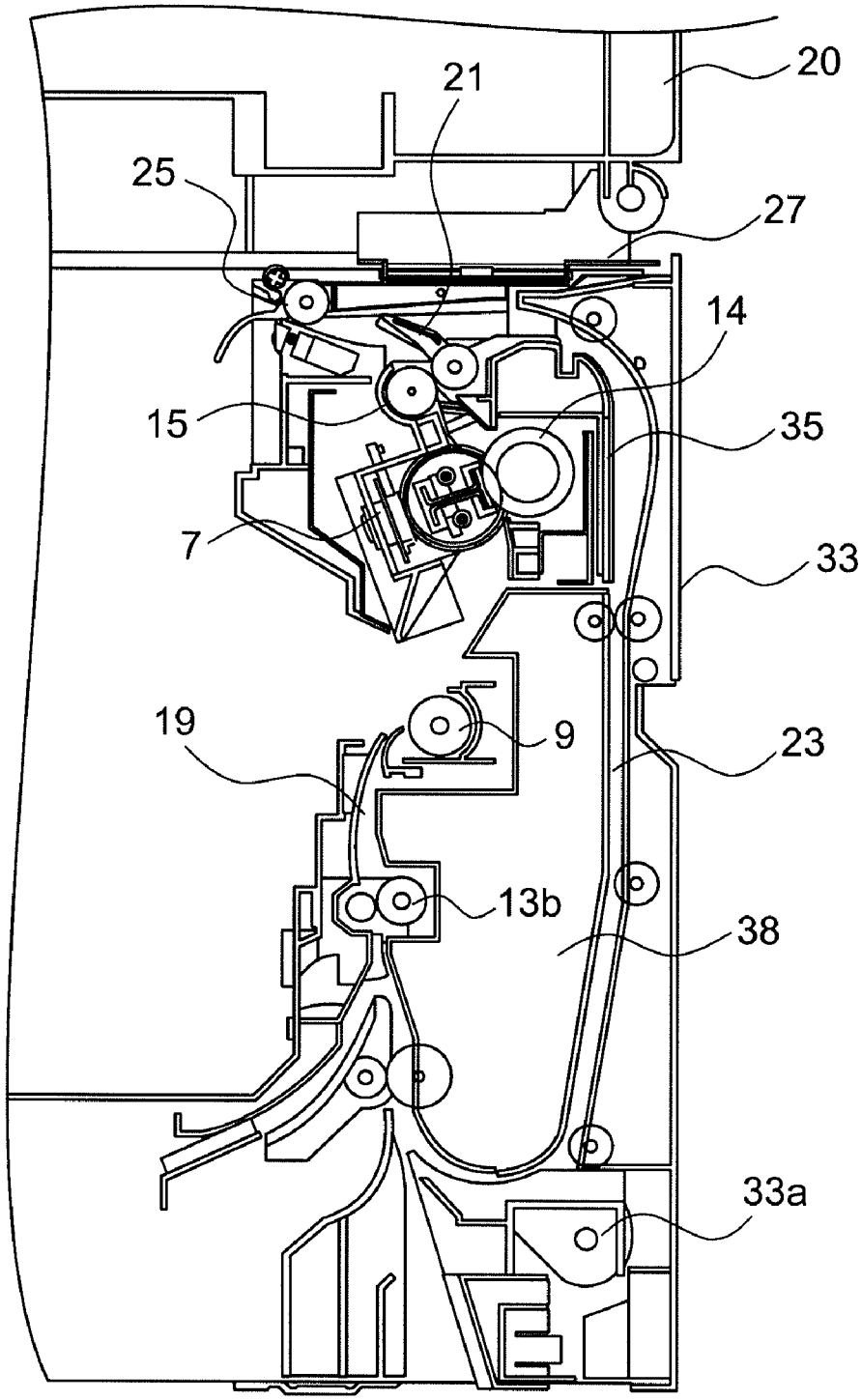
FIG. 6 is a side sectional view of a paper conveyance path in the image forming apparatus according to the embodiment.
Figure 7:
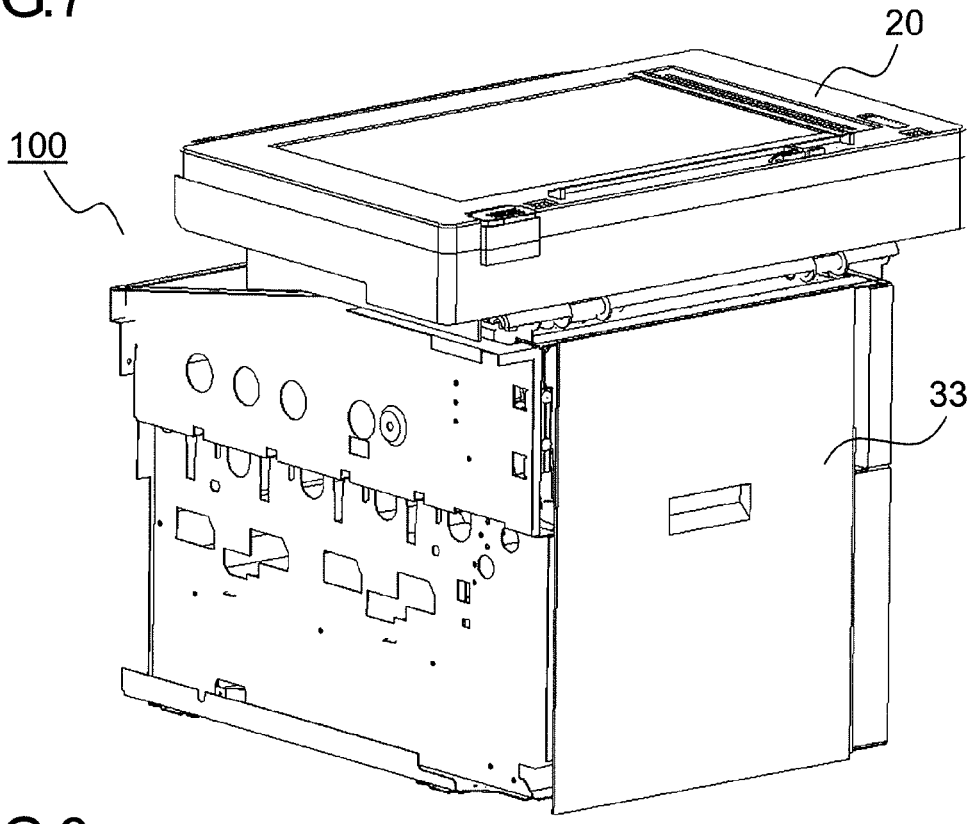
FIG. 7 is a perspective view in which the image forming apparatus according to the embodiment is seen from a back surface side thereof.

Next, a jam processing method in a case where in the image forming apparatus 100 according to the embodiment, paper is jammed around the fixing unit will be described. As shown in FIG. 6 and FIG. 7, on a back side of the image forming apparatus 100, a side surface cover 33 constituting a part (external surface) of the double-side conveyance path 23 is rotatably supported on a pivot 33*a*. Moreover, inside the side surface cover 33, a conveyance unit 38 constituting a part (internal surface) of the double-side conveyance path 23 and a part (external surface) of the paper conveyance path 19 upstream (on a lower side) of the fixing unit 7 is rotatably supported with a lower end portion thereof as a pivot.

Figure 8:
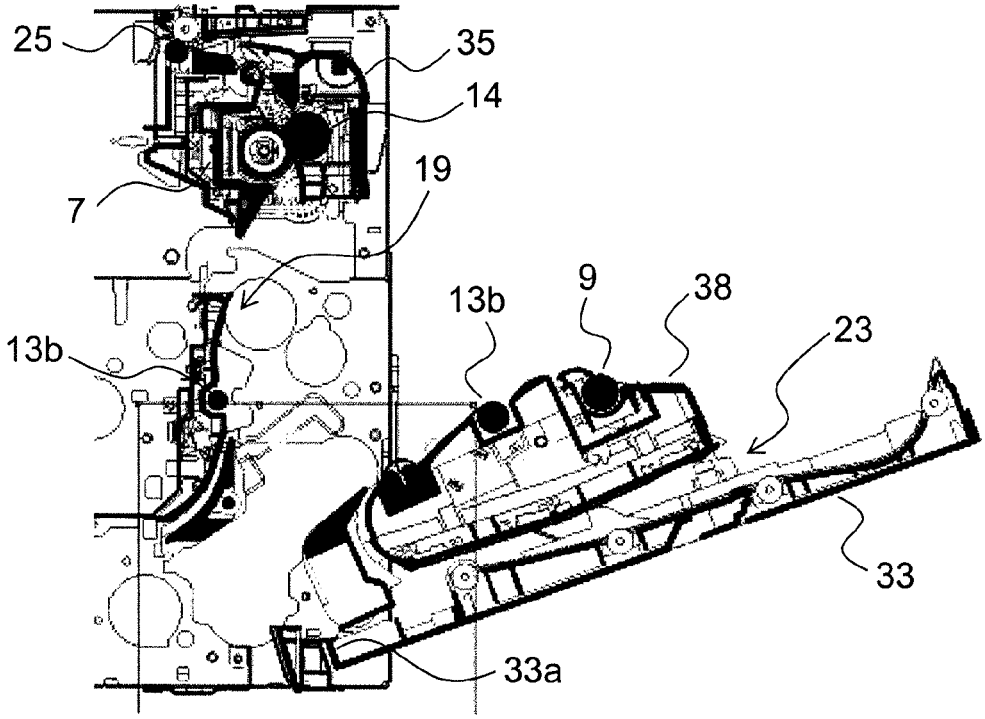
FIG. 8 is a side sectional view showing a state where a side surface cover of the image forming apparatus according to the embodiment is opened.

In a case where paper is jammed on the paper conveyance path 19 upstream of the fixing unit 7, upon opening the side surface cover 33 as shown in FIG. 8, the conveyance unit 38 is also opened concurrently with the opening of the side surface cover 33. In the conveyance unit 38, the secondary transfer roller 9 and one roller of the registration roller pair 13*b* are disposed. By opening the conveyance unit 38, a part (an upstream side of the fixing unit 7) of the paper conveyance path 19 is exposed, thereby allowing the jam processing.

In a case where paper is jammed on the double-side conveyance path 23 above the fixing unit 7, by opening the side surface cover 33 as shown in FIG. 8, an upper half of the double-side conveyance path 23 is exposed, thereby allowing the jam processing. Moreover, in a case where paper is jammed on the double-side conveyance path 23 below the fixing unit 7, by lifting up only the conveyance unit 38 which is in the state shown in FIG. 8, a lower half of the double-side conveyance path 23 is exposed, thereby allowing the jam processing. After the jammed paper has been removed, as shown in FIG. 6 and FIG. 7, the conveyance unit 38 and the side surface cover 33 are returned to a closed state.

On the other hand, in a case where paper is jammed on the paper conveyance path 19 on the downstream side of (above) the fixing unit 7, the fixing jam processing cover 35 disposed inside the side surface cover 33 is opened. Here, in order to guide paper routed from the conveyance roller pair 15 toward the discharge roller pair 25, the conveyance guide member 21 is ordinarily located in the first position shown in FIG. 2. If an attempt is made to open and close the fixing jam processing cover 35 with the conveyance guide member 21 fixed in the first position, the reinforcement metal sheet 27, which is positioned in the rotation trajectory of the conveyance guide member 21, will interfere with the conveyance guide member 21, making smooth opening and closing of the fixing jam processing cover 35 impossible.

Figure 9:
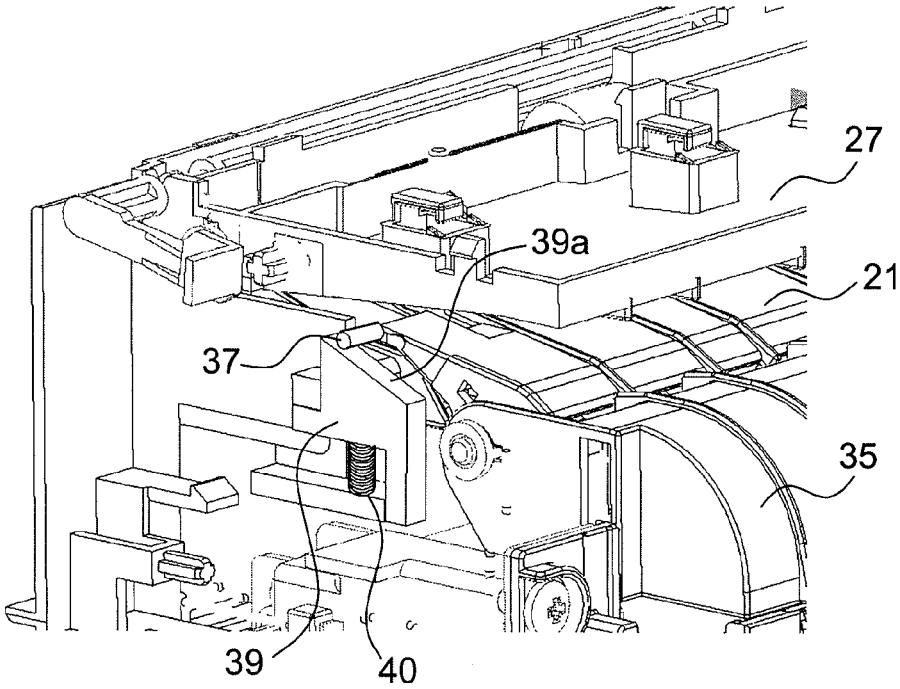
FIG. 9 is an enlarged view showing a relationship between the conveyance guide member and a supporting member in a state where in the image forming apparatus according to the embodiment, a fixing jam processing cover is closed.

To avoid that, adopted is a configuration in which upon opening and closing the fixing jam processing cover 35, the conveyance guide member 21 does not interfere with the reinforcement metal sheet 27 in an upper surface of the image forming apparatus 100. As shown in FIG. 9, with the fixing jam processing cover 35 closed, a positioning protrusion 37 provided on, so as to protrude from, the swinging end 21*a* of the conveyance guide member 21 makes contact with an upper end portion of an inclined surface 39*a* of the supporting member 39, thereby positioning the conveyance guide member 21 in the first position.

Figure 11:
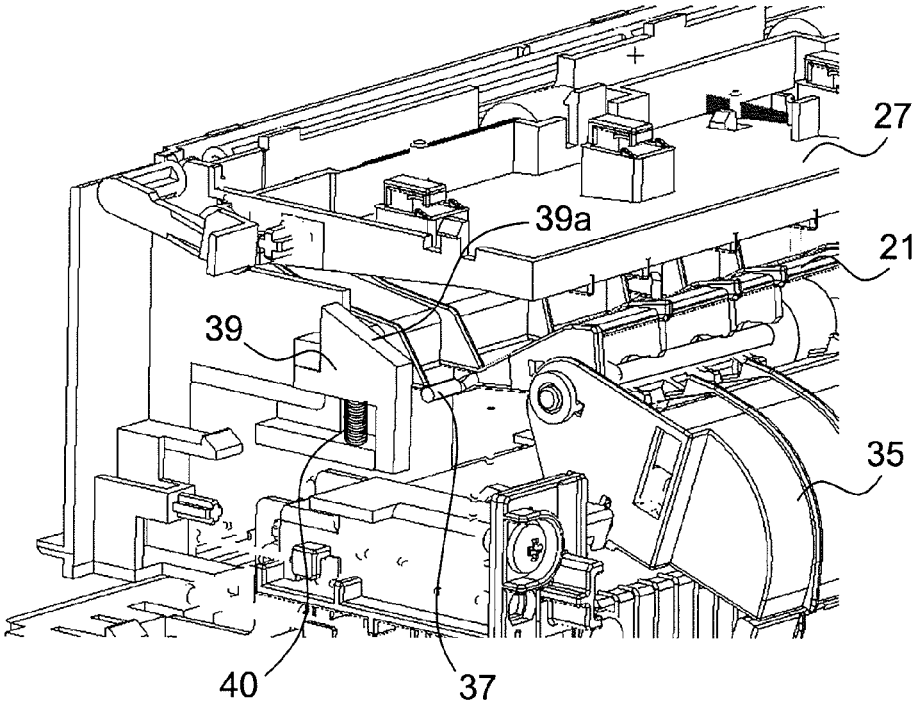
FIG. 11 is an enlarged view showing a state where the fixing jam processing cover in a state shown in FIG. 10 is further rotated.

As the fixing jam processing cover 35 is being rotating downward from the state shown in FIG. 9, as shown in FIG. 10, the positioning protrusion 37 moves downward along the inclined surface 39*a* of the supporting member 39 due to the self weight of the conveyance guide member 21. This causes the conveyance guide member 21 to incline gradually from a horizontal to a downward-tilted position, and as shown in FIG. 11, the conveyance guide member 21 rotates in conjunction with the fixing jam processing cover 35 while avoiding the interference with the reinforcement metal sheet 27.

Figure 12:
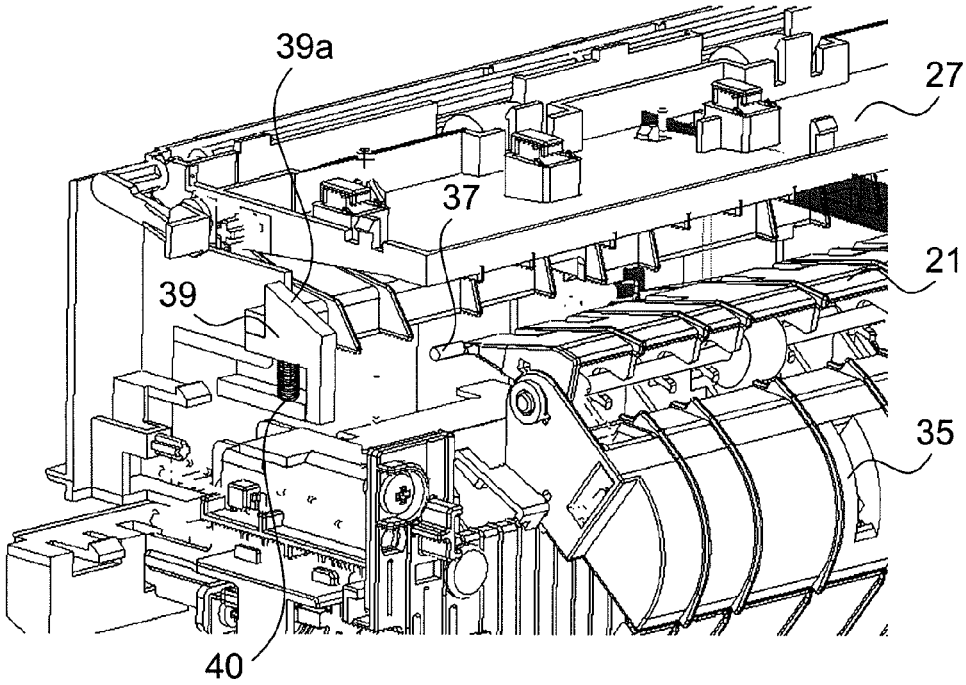
FIG. 12 is an enlarged view showing a state where in the image forming apparatus according to the embodiment, the conveyance guide member in conjunction with the fixing jam processing cover is separated from an apparatus main body.
Figure 13:
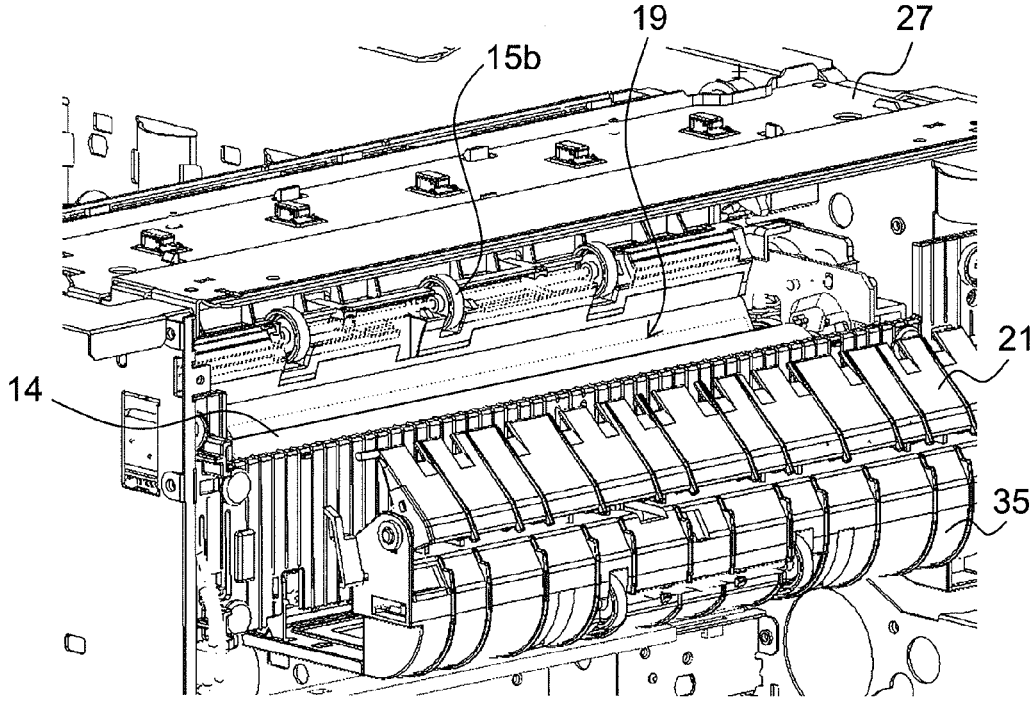
FIG. 13 is a perspective view in which in the image forming apparatus according to the embodiment, a state where the fixing jam processing cover is opened is seen from the back surface side thereof.
Figure 14:
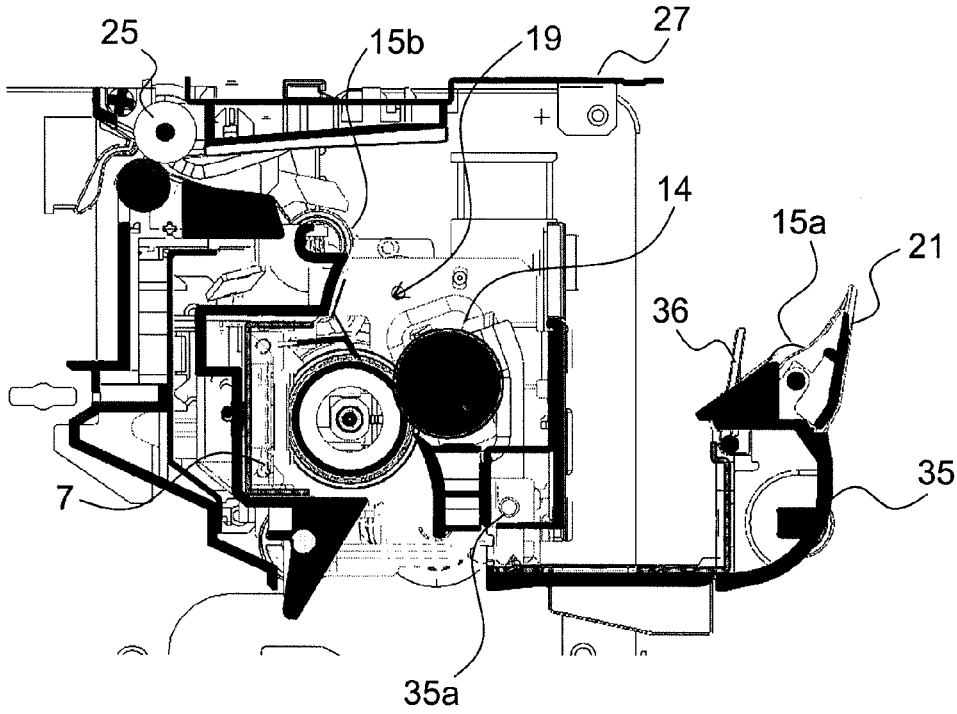
FIG. 14 is a side sectional view showing a state where in the image forming apparatus according to the embodiment, the fixing jam processing cover is opened.

Upon further being rotating the fixing jam processing cover 35, as shown in FIG. 12, the conveyance guide member 21 is completely separated from the apparatus main body MB of the image forming apparatus 100, and as shown in FIG. 13 and FIG. 14, a part (on the downstream side of the fixing unit 7) of the paper conveyance path 19 is exposed, thereby allowing the jam processing. After the jammed paper has been removed, as the fixing jam processing cover 35 is being closing, the positioning protrusion 37 moves upward along the inclined surface 39*a* of the supporting member 39, that is, backward compared with when the fixing jam processing cover 35 is opened. This causes the conveyance guide member 21 to incline gradually upward (less and less downward-tilted), and when the fixing jam processing cover 35 is completely closed (refer to FIG. 9), the conveyance guide member 21 is located again in the first position. The conveyance unit 38 and the side surface cover 33 are returned to a closed state as shown in FIG. 6 and FIG. 7, and the jam processing is finished.

Moreover, the supporting member 39 is supported in a vertically movable manner and provided with the coil spring 40 for urging the supporting member 39 upward. When the solenoid 31 (refer to FIG. 5) is actuated with the fixing jam processing cover 35 closed, the conveyance guide member 21 presses down the supporting member 39 against the urging force of the coil spring 40, and thus the conveyance guide member 21 itself swings downward and is located in the second position.

By adopting the configuration described above, the interference of the conveyance guide member 21 with the reinforcement metal sheet 27 upon opening or closing the fixing jam processing cover 35 is avoided, and the fixing jam processing cover 35 can be smoothly opened or closed. Accordingly, while operability upon the jam processing is enhanced, a height of the whole apparatus can be kept low, and stiffness can be enhanced by the reinforcement metal sheet 27. Moreover, when the fixing jam processing cover 35 is closed, the conveyance guide member 21 can be located again in the first position in an ensured manner.

Moreover, since the supporting member 39 is vertically movable and urged upward by the coil spring 40, the swinging of the conveyance guide member 21 by the solenoid 31 is not hindered. Accordingly, the sorting of the paper conveyance direction by the conveyance guide member 21 can be smoothly performed.

Moreover, since the double-side conveyance path 23 is structured so as to have the back surface C path, in a case where paper is jammed on the double-side conveyance path 23, the jammed paper can be easily removed by opening the side surface cover 33.

The present disclosure is not limited to the embodiment described above, and various modifications can be made within a range not deviating from the spirit of the present disclosure. For example, although adopted in the embodiment described above is the configuration in which the side surface cover 33 and the fixing jam processing cover 35 are opened or closed toward the back surface side of the apparatus main body MB (right side in FIG. 6), for example, a configuration in which the double-side conveyance path 23 is provided along the side surface of the apparatus main body MB (the front side of the sheet of FIG. 6) and the side surface cover 33 and the fixing jam processing cover 35 are opened and closed toward the side surface side can be adopted.

Moreover, the present disclosure is not limited to the color copier shown in FIG. 1, and it is a matter of course that the present disclosure is applicable to other vertical conveyance-type image forming apparatuses such as an analog-type copier, a digital multi-functional peripheral, monochrome and color printers, and a facsimile.

By adopting the configuration according to the present disclosure, the conveyance guide member slides along the inclined surface of the supporting member upon opening or closing the fixing jam processing cover, whereby an inclination with respect to a horizontal direction of the conveyance guide member is decreased and the conveyance guide member does not interfere with the image forming apparatus main body. Thus, not only the operability upon the jam processing is enhanced, but also the height of the whole apparatus can be kept low.

What is claimed is:

1. An image forming apparatus comprising:

an image forming unit configured to form a toner image;

a transfer unit configured to transfer on a recording medium the toner image formed by the image forming unit;

a fixing unit configured to fuse an unfixed toner image transferred by the transfer unit to fix the toner image on the recording medium;

a discharge unit provided above the fixing unit and configured to discharge the recording medium having the toner image fixed thereon by the fixing unit;

a fixing jam processing cover configured to rotate with a lower end portion thereof as a pivot with respect to an apparatus main body so as to open or close a part of a paper conveyance path from the fixing unit to the discharge unit;

a conveyance guide member swingably provided on a rotation end of the fixing jam processing cover and configured to guide, with the fixing jam processing cover closed, to the discharge unit the recording medium having passed through the fixing unit; and a supporting member configured to have an inclined surface with which a part of the conveyance guide member makes contact and along which, as the fixing jam processing cover is being opened, the conveyance guide member slides to become less inclined with respect to a horizontal direction.

2. The image forming apparatus according to claim 1, wherein, as the fixing jam processing cover is being closed, the conveyance guide member slides along the inclined surface into a position where the conveyance guide member guides to the discharge unit the recording medium having passed through the fixing unit.

3. The image forming apparatus according to claim 1, wherein the fixing jam processing cover has the pivot below the fixing unit.

4. The image forming apparatus according to claim 1, further comprising a double-side conveyance path configured to switch back the recording medium having guided to the discharge unit to convey the recording medium to the transfer unit once again, wherein after the recording medium has passed through the conveyance guide member and been guided to the discharge unit, the conveyance guide member is swung to guide to the double-side conveyance path the recording medium switched back.

5. The image forming apparatus according to claim 2, further comprising a double-side conveyance path configured to switch back the recording medium having guided to the discharge unit to convey the recording medium to the transfer unit once again, wherein after the recording medium has passed through the conveyance guide member and been guided to the discharge unit, the conveyance guide member is swung to guide to the double-side conveyance path the recording medium switched back.

6. The image forming apparatus according to claim 4, wherein the supporting member is vertically movable and urged upward by a resilient member.

7. The image forming apparatus according to claim 5, wherein the supporting member is vertically movable and urged upward by a resilient member.

8. The image forming apparatus according to claim 4, further comprising a side surface cover of the apparatus main body, wherein the double-side conveyance path is formed between the fixing jam processing cover and the side surface cover of the apparatus main body, and by opening or closing the side surface cover, a part of the double-side conveyance path is opened or closed.

9. The image forming apparatus according to claim 5, further comprising a side surface cover of the apparatus main body, wherein the double-side conveyance path is formed between the fixing jam processing cover and the side surface cover of the apparatus main body, and by opening or closing the side surface cover, a part of the double-side conveyance path is opened or closed.

10. The image forming apparatus according to claim 1, further comprising an image reading unit configured to scan and read out a document is mounted on an upper surface of the apparatus main body, a reinforcement member configured to support the image reading unit and provided above the fixing jam processing cover, wherein, as the fixing jam processing cover is being opened, the conveyance guide member slides along the inclined surface to thereby avoid contact between the conveyance guide member and the reinforcement member.

11. The image forming apparatus according to claim 2, further comprising an image reading unit configured to scan and read out a document is mounted on an upper surface of the apparatus main body, a reinforcement member configured to support the image reading unit and provided above the fixing jam processing cover, wherein, as the fixing jam processing cover is being opened, the conveyance guide member slides along the inclined surface to thereby avoid contact between the conveyance guide member and the reinforcement member.

12. The image forming apparatus according to claim 3, further comprising an image reading unit configured to scan and read out a document is mounted on an upper surface of the apparatus main body, a reinforcement member configured to support the image reading unit and provided above the fixing jam processing cover, wherein, as the fixing jam processing cover is being opened, the conveyance guide member slides along the inclined surface to thereby avoid contact between the conveyance guide member and the reinforcement member.

13. The image forming apparatus according to claim 4, further comprising an image reading unit configured to scan and read out a document is mounted on an upper surface of the apparatus main body, a reinforcement member configured to support the image reading unit and provided above the fixing jam processing cover, wherein, as the fixing jam processing cover is being opened, the conveyance guide member slides along the inclined surface to thereby avoid contact between the conveyance guide member and the reinforcement member.

14. The image forming apparatus according to claim 5, further comprising an image reading unit configured to scan and read out a document is mounted on an upper surface of the apparatus main body, a reinforcement member configured to support the image reading unit and provided above the fixing jam processing cover, wherein, as the fixing jam processing cover is being opened, the conveyance guide member slides along the inclined surface to thereby avoid contact between the conveyance guide member and the reinforcement member.

* * * * *